US005373763A

United States Patent [19]

Takahara

[11] Patent Number: 5,373,763

[45] Date of Patent: Dec. 20, 1994

[54] APPARATUS FOR CUTTING FIBER

[75] Inventor: Katsuomi Takahara, Mukou, Japan

[73] Assignee: Kabushiki Kaisha Takehara Kikai Kenkyusho, Kyoto, Japan

[21] Appl. No.: 40,984

[22] Filed: Mar. 31, 1993

[30] Foreign Application Priority Data

May 28, 1992 [JP] Japan ..... 4-181508

[51] Int. Cl.[5] ..... D01G 1/04

[52] U.S. Cl. ..... 83/175; 83/410.8; 83/474; 83/733; 83/913

[58] Field of Search ..... 83/175, 410.8, 410.9, 83/733, 474, 913, 18

[56] References Cited

U.S. PATENT DOCUMENTS

| | | | |
|---|---|---|---|
| 3,218,898 | 11/1965 | Briscoe | 83/913 |
| 3,472,107 | 10/1969 | Heijnis | 83/913 |
| 3,915,042 | 10/1975 | Laird | 83/341 |
| 3,942,401 | 3/1976 | Roncato | 83/19 |
| 3,945,280 | 3/1976 | Roncato | 83/98 |
| 4,083,276 | 4/1978 | Hutzezon | 83/37 |
| 5,163,348 | 11/1992 | Kitada et al. | 83/913 |

FOREIGN PATENT DOCUMENTS

| | | |
|---|---|---|
| 50-116723 | 9/1975 | Japan . |
| 56-73118 | 6/1981 | Japan . |
| 56-73119 | 6/1981 | Japan . |
| 57-95314 | 6/1982 | Japan . |
| 59-27405 | 7/1984 | Japan . |
| 1-210540 | 8/1989 | Japan . |

*Primary Examiner*—Hien H. Phan

*Attorney, Agent, or Firm*—Wenderoth, Lind & Ponack

[57] ABSTRACT

An apparatus for cutting a crimped fiber bundle accurately at a high speed in compliance with the high-speed capacity of a crimping machine has a rotor including bisymmetrical finger disks, hook-shaped fingers extending from peripheries of the finger disks, and clamping disks which rotate at a uniform speed at the back of the finger disks. The fingers cross each other at one location in the apparatus adjacent the peripheries of the finger disks to form an interlocking area, which defines an inlet for the fiber bundle. Downstream of the interlocking area in the rotating direction of the rotor is formed a hooking area where the fiber bundle is pulled into a zigzag configuration. Finally, the fiber bundle assuming the zigzag configuration is cut.

4 Claims, 4 Drawing Sheets

APPARATUS FOR CUTTING FIBER

BACKGROUND OF THE INVENTION

1. Field of the Invention

The present invention relates to an apparatus for cutting fiber, which is situated, for instance, at the back of the nip roller of a crimping machine and which is designed to cut a fiber bundle crimped by a crimping machine to various lengths.

2. Description of the Prior Art

Among conventional cutting apparatus of this kind, there is an outer track type of cutting apparatus, for example, as disclosed in the published Examined Japanese Patent Application Sho. 59(1984)-27405, Unexamined Japanese Patent Application Sho. 56(1981)-73118, Unexamined Japanese Patent Application Sho. 56(1981)-73119 and Unexamined Japanese Patent Application Sho. 57(1982)-95314. In this type of apparatus, a cutting blade is provided on the circumference of a rotary disk, and a fiber bundle is wound around the disk and is cut to lengths corresponding to the interval of blades under pressure created by a pressure roll provided outside of the disk.

There are also some different types of known fiber cutting apparatus. One of these is an inner track type as disclosed, for example, in the published Unexamined Japanese Patent Application Sho. 50(1975)-116723. In this apparatus cutting blades are provided in a circle with their edges directed inward and the fiber bundle is cut between these blades under pressure created by a pressure roller provided outside of the circle. There is also an inner and outer combined track type of cutting apparatus which combines a disk having cutting blades on its circumference and a ring having cutting blades on its inner surface and wherein the fiber bundle is cut between the two pairs of blades.

Cutting apparatus of the conventional types are all designed to cut the fiber bundle at a location between the blades arranged in a circle. Accordingly, a slackening of the fiber bundle between the blades or the production of flock due to the shaving of the bundle by the blades during the movement of the fiber bundle cannot be prevented. Further, in the case of a high speed crimping apparatus having a nip acceleration speed of 6,000 m per minute, as disclosed in Unexamined Patent Application Hei. 1(1989)-201540, the fiber bundle could not be cut accurately.

SUMMARY OF THE INVENTION

An object of the present invention is to overcome the above-described drawbacks in the prior art by providing an apparatus for cutting the fiber crimped by a crimping machine, the apparatus comprising: a rotor to receive a fiber bundle from a crimping machine, the rotor including bisymmetrical finger disks, a large number of hook-shaped fingers extending from the peripheries of each of the disks with the fingers extending from one of the disks being arranged alternately with respect to the other fingers, axes of rotation of the disks intersecting at an oblique angle in the center of the apparatus such that rotary surfaces of the disks are inclined relative to each other, and the disks rotating at the same speed in the same direction, and by bisymmetrical clamping disks arranged, respectively, at the back of the finger disks and rotating at the same speed in the same direction as the finger disks. Accordingly, an interlocking area is formed, at one location in the apparatus where the peripheries of the bisymmetrical finger disks are closest to each other, by the hook-shaped fingers which cross each other in the interlocking area so as to define an inlet for the fiber bundle. Further a zigzag hooking area is also formed whereat the fiber bundle is pulled into a zigzag configuration by the fingers separating from one another in accordance with the separation of the rotary surfaces of the finger disks at a location downstream of the interlocking area. Finally, a clamping area is formed at which the fiber bundle is held between the fingers and the rims of the clamping disks. The apparatus also includes a cutting blade to cut the zigzag fiber bundle tensioned in the clamping area between the two finger disks.

In the apparatus of the present invention having such structure, the interlocking area, which is formed by terminal ends of the fingers at the location where the rotary surfaces of the finger disks are closest to each other, is utilized as an inlet for the fiber bundle whereat the fiber bundle can be fed into the apparatus without difficulty. The fiber bundle taken in at the inlet is hooked by the fingers which separate from each other as the rotary surfaces of the finger disks separate from each other in the rotating direction of the rotor, and rotates together with the rotor while assuming a zigzag configuration.

At a clamping position where the rotary surfaces of the finger disks are most remote from one another, the amplitude of the zigzag configuration is the largest and the fiber bundle is tensioned as it is held between the fingers and the rims of the clamping disks.

The cutting blade cuts the fiber bundle tensioned in the clamping area.

Typically, the fiber bundle in the clamping area is cut evenly in the center between the finger disks. Alternatively the fiber bundle may be cut at a position displaced from the center to produce unevenly cut lengths.

Further, the bisymmetrical finger disks and clamping disks may be coupled by joints provided, respectively, at the ends of the rotary shafts supporting the clamping disks. This is advantageous in terms of simplifying the structure of the rotor and facilitating smooth rotation.

Moreover, according to the present invention, one of the rotary shafts can be swung in the same plane as the axes of rotation of the finger disks such that the amplitude of the zigzag configuration of the fiber bundle can be varied by changing the inclination of the axis of the rotary shaft. This allows the cut length of the fiber, which is determined by the amplitude of the zigzag configuration of the fiber in the clamping area, to be changed without replacing the finger disks and clamping disks.

DETAILED DESCRIPTION OF THE PREFERRED EMBODIMENTS

Now, the apparatus according to the invention will be described below with reference to the preferred embodiments thereof shown in FIGS. 1–4 of the attached drawings.

Figure 1:
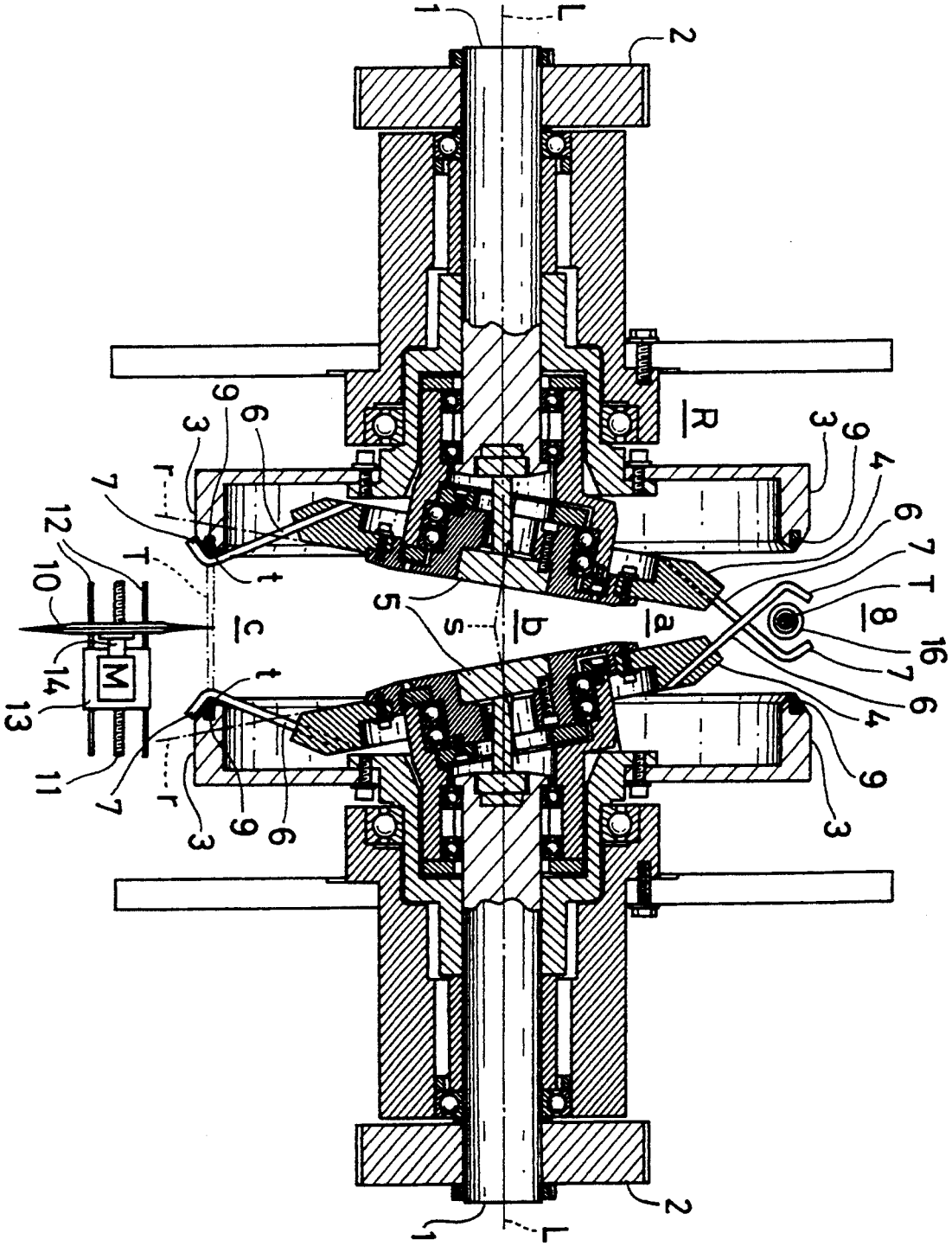
FIG. 1 is a longitudinal elevation view, partially in section, of a first embodiment of a fiber cutting apparatus according to the present invention.

FIG. 1 shows an embodiment in which an axis (L) of a pair of bisymmetrical clamping disks 3, 3 constituting a rotor (R) is situated on a horizontal straight line.

In the drawings, rotary shafts 1, 1 support clamping disks 3, 3. Pulleys 2, 2 are fixed, respectively, to external ends of the shafts 1, 1 and are driven by motors not shown in the drawings. Finger disks 4, 4 are rotatively driven together with the clamping disks 3, 3 through joints 5, 5 which are provided, respectively, on the internal end of the rotary shafts 1, 1 so as to rotate at the same speed as the shafts 1, 1.

The finger disks 4, 4 are provided with a large number of hook-shaped fingers 6, 6 at equal intervals on their respective circumferences, and are arranged bisymmetrically in such way that the hook-shaped fingers 6 on one finger disk cross over the hook-shaped fingers 6 on the other finger disk 4. This can be accomplished by offsetting the disks 4, 4 by half of a pitch in the circumferential directions. Further, these bisymmetrical finger disks 4, 4 have axes which intersect at point (s) midway therebetween at an oblique angle corresponding to the angle of inclination of joints 5, 5. Thus, rotary surfaces (r), (r) of the disks 4, 4 are inclined relative to each other and rotate at the same speed and in the same direction.

The fingers 6, 6 have respective tops 7 in the shape of a hook the end of which bends toward the back of the disk. At a location where the rotary surfaces (r), (r) of the bisymmetrical finger disks 4, 4 are closest to each other is an interlocking area (a) where the crossing fingers 6, 6 of the disks 4, 4 interlock a fiber bundle (T) by alternately extending thereover from the right and left thereof. In the apparatus of the present invention, an inner side of the interlocking area (a) defines an inlet 8 for the fiber bundle (T).

Downstream of said interlocking area (a) in the rotary direction of the apparatus is a zigzag hooking area (b) where the fingers 6, 6 of the disks 4, 4 separate to the right and left from each other in accordance with the separation of the inclined rotary surfaces (r), (r) of the finger disks 4, 4.

The fiber bundle (T) supplied through the inlet 8 is hooked by the tops 7, 7 of the fingers 6, 6, then is pulled to form bent parts (t), (t) as the fingers 6, 6 separate and rotate together with the fingers disks 4, 4.

At a location diametrically opposite the interlocking area (a) is a clamping area (c) where the rotary surfaces (r), (r) of the inclined finger disks are located furthest from each other.

In other words, the fingers 6, 6 extending, respectively, around the rotary surfaces (r), (r) of the finger disks separate from each other the most in this clamping area (c), approach rims 9, 9 of the clamping disks 4, 4, which are rotating at a uniform speed with and at the rear of the finger disks 4, 4 and clamp the bent parts (t), (t) of the finger bundle (T), which have reached the clamping area (c), against the rims 9, 9 of the clamping disks 3, 3.

Due to the expansion of the space between the fingers 6, 6 of the disks 4, 4 and due to the above-described clamping, the fiber bundle (T) gets tensioned most in the clamping area (c) and, while such tension is maintained, the fiber bundle (T) is cut by a rotating disk-shaped cutting blade 10 which is situated radially outward of the central area between the finger disks 4, 4.

In this embodiment, the cutting blade 10 is fixed to a shaft 14 of motor (M) mounted on a stand 13 which is supported by a screw shaft 11 and rails 12, 12.

When the cutting blade 10 is located at the center between the two finger disks, the fiber bundle (T) is cut in the center between the bent parts (t), (t) into equal lengths. When the cutting blade 10 is displaced to the right or left of center, the cut lengths of the fiber are uneven. Further, by turning the screw shaft 11 to and fro at an optional speed and thus reciprocating the cutting blade 10, the cut lengths of the fiber change continuously, whereby fibers of various cut lengths are obtained.

The fingers 6, 6 having passed the clamping area (i.e. cutting position) separate from the clamping disks 3, 3 and move successively toward the inlet 8 so as to release the cut fibers and let them fall.

Figure 2:
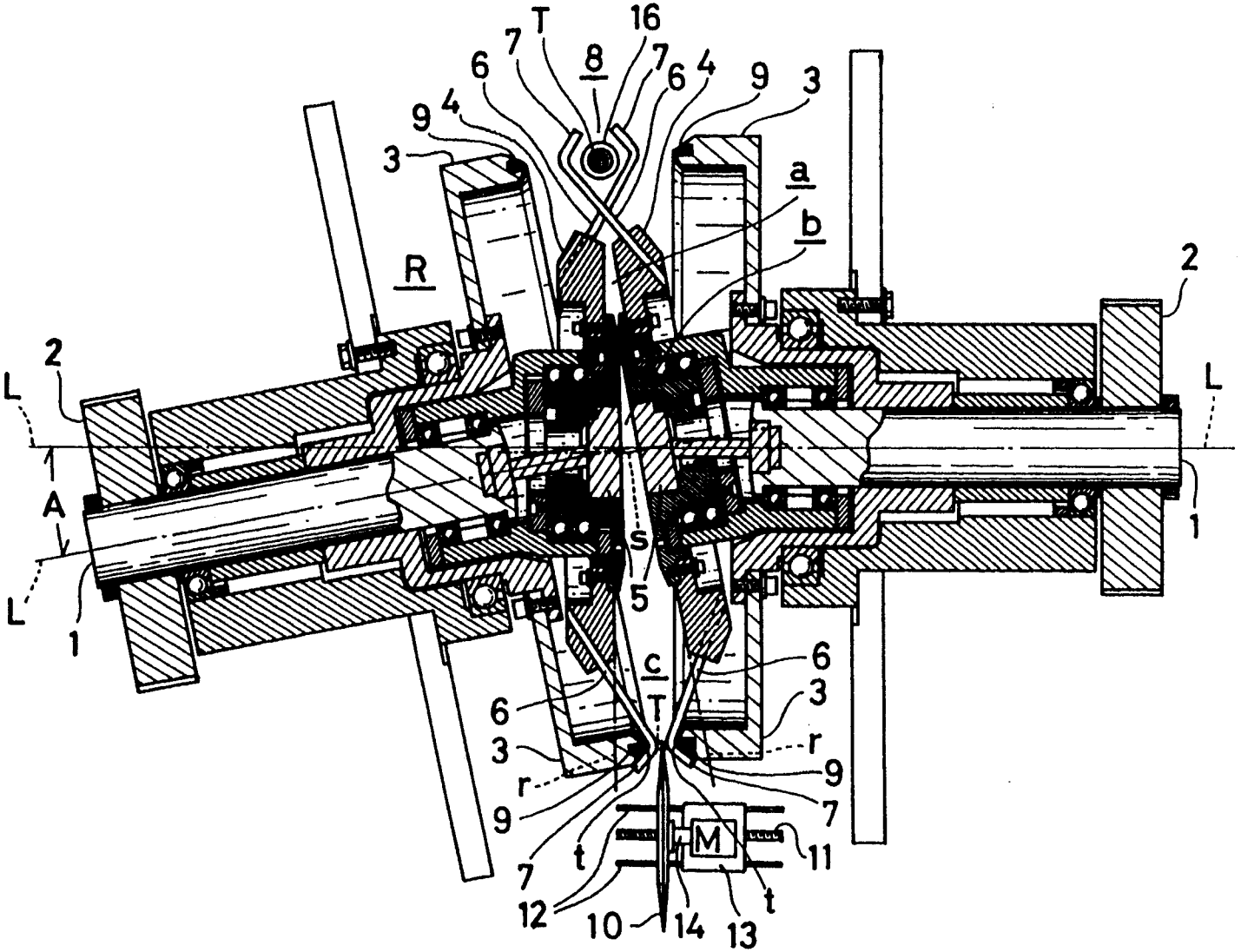
FIG. 2 is a similar view of the second embodiment of the present invention.

In the second embodiment of FIG. 2 one of the rotary shafts 1, 1 (the left one in the drawing) of the bisymmetrical clamping disks 3, 3 is inclined relative to the horizontal so as to be disposed along the axis of the finger disk 4 mounted to the other of the rotary shafts 1, 1.

In the working example 2, the finger disk 4 and the clamping disk 3 mounted to the inclined rotary shaft are correspondingly inclined such that the rotary surfaces (r), (r) of the finger disks 4, 4 are nearly parallel, whereby the amplitude of the zigzag configuration assumed by the fiber bundle (T) in the zigzag hooking area (b) is different than in the first embodiment.

When the inclination angle (A) of the finger disk 4 is made variable, the amplitude of the zigzag configuration can be varied and, by cutting the fiber bundle (T) in the middle of such zigzag configuration, evenly cut lengths of the fiber bundle (T) are obtained. Further, by moving the cutting position transversely of the zigzag configuration, it becomes possible to cut the fiber bundle to uneven lengths. Therefore, when it is desired to change the cut length of the fiber bundle, it is unnecessary to change the parts of the apparatus such as the parts of the rotor. Thus, the operating efficiency is high and operating costs are saved.

That is to say, in the first embodiment, the inclination angle of the finger disk 4 is fixed and so the amplitude of the zigzag configuration of the fiber bundle (T) produced by the fingers 6, 6 is constant. However, in the second embodiment, it is possible to change both the amplitude of the zigzag configuration and the cut lengths of the fiber by changing the inclination angle (A) of the finger disk 4 which is variable.

Further, in these embodiments, the rims 9, 9 are formed by mounting synthetic resin rings of a highly anti-wear characteristic to main bodies of the clamping disks.

Figure 3:
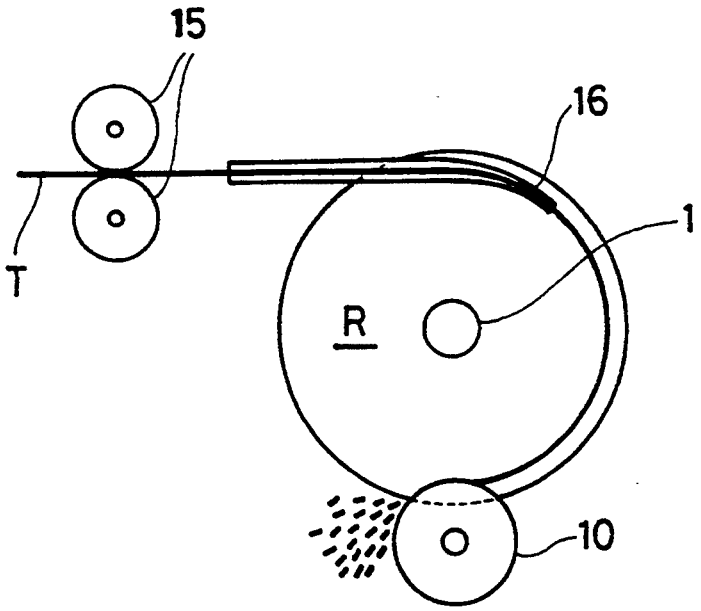
FIG. 3 is a schematic view showing the arrangement of the apparatus of the present invention.
Figure 4:
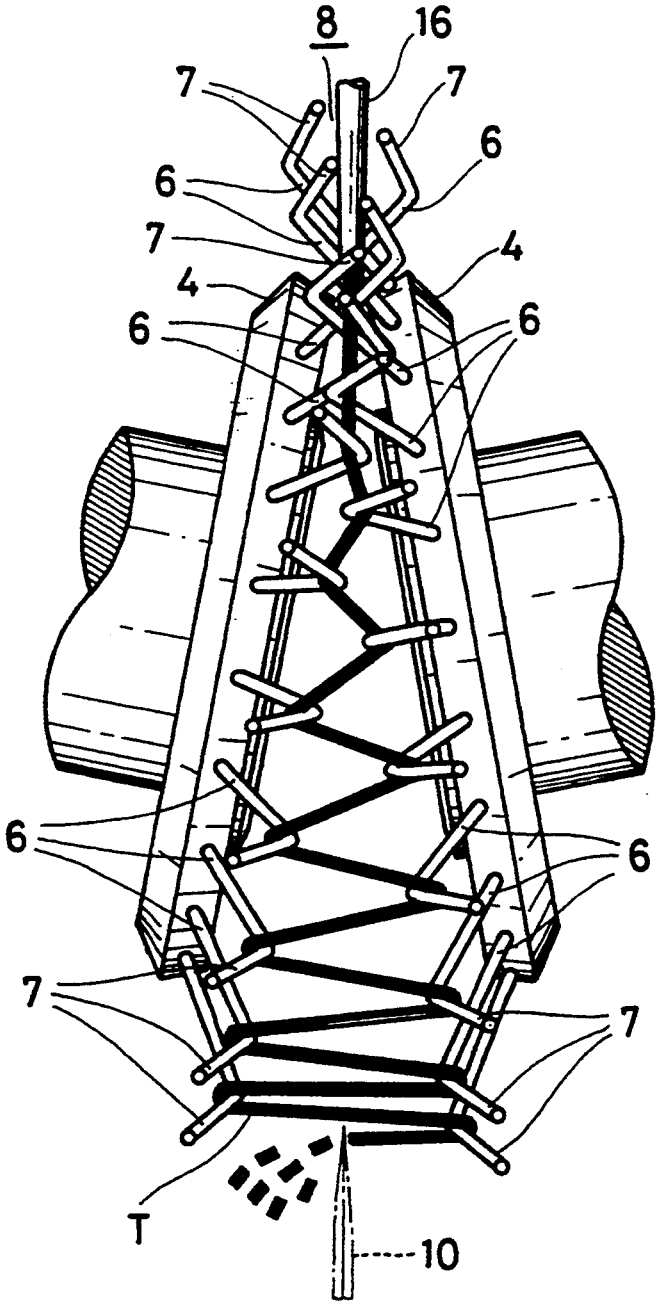
FIG. 4 is a front view of the apparatus showing the fingers pulling the fiber bundle into a zigzag configuration in the hooking area.

FIG. 3 shows feed rollers 15, 15 for conveying the fiber bundle (T) which might have been crimped by a crimping apparatus (which is omitted in the drawings), and a discharging nozzle 16 for guiding the fiber bundle (T) toward the inlet 8.

As described above, the present invention includes a large number of hook-shaped fingers extending from the circumferences of bisymmetrical finger disks having inclined rotary surfaces forming (1) an interlocking area serving as the inlet for the fiber bundle, (2) a hooking area at which the fiber bundle is pulled by the fingers to assume a zigzag configuration, and (3) a clamping area at which the amplitude of the zigzag configuration of the fiber bundle is largest, at which the fiber bundle is clamped by the finger to the rims of the clamping disks situated at the back of the finger disks, and at which the fiber bundle is cut between the finger disks. Accordingly, it is possible to set the circumferential speed of the rotor lower than the crimping speed of the crimping machine and to cope with a high-speed operation of the crimping machine.

The present invention guarantees accurate cutting of fiber because the fiber bundle is clamped by the fingers to the rims of the finger disks, and is cut in a space where it is tensioned.

Further, the present invention enables the cut length of the fiber to be changed without the need to replace parts such as the rotor or cutting blade, and improves operation efficiency. The present invention also enables the amplitude of the configuration of the cut length of the fiber to be changed by varying the inclination of one of the finger disks.

As described above, the present invention is extremely useful in terms of the cutting of the fiber and the changing and setting of the cut length of fiber.

I claim:

1. An apparatus for cutting fiber, comprising:

a pair of finger disks spaced apart from one another along a first axis passing through centers of each of said disks, each said disk being rotatably supported about a respective axis of rotation passing through the center thereof, the axes of rotation of said disks intersecting at an oblique angle at a location midway between the disks such that peripheries of said disks are closest to one another at one location in the apparatus and are most remote from one another at another location in the apparatus, and said disks being symmetrical to one another about a first plane bisecting said oblique angle at said location;

a plurality of fingers spaced along and extending from the peripheries of each of said disks, the fingers of each one of said disks being hook-shaped by having a bend therein and a terminal end extending from the bend toward a rear side of said one of said disks in a direction away from the other of said disks, the fingers extending from one of said disks being alternately disposed, in the circumferential directions of the disks, with the fingers extending from the other of said disks, the fingers extending from one of said disks crossing the fingers extending from the other of said disks at said one location where the peripheries of the disks are closest to each other so as to define an interlocking area at said one location forming an inlet of the apparatus where fiber to be cut by the apparatus is input, the fingers extending from one of said disks being spaced, in a direction corresponding to that of said first axis, from the fingers extending from the other of said disks at said another location where the peripheries of the disks are most remote from one another so as to define a clamping area, and a hooking area being defined in the apparatus adjacent the peripheries of the disks at a third location in the apparatus between said interlocking area and said clamping area in the circumferential directions of said disks, fiber to be cut by the apparatus being held by said fingers in said hooking area in a zigzag configuration;

clamping disks disposed to the rear sides of said disks, respectively, said clamping disks being symmetrical to each other about said first [and said second planes]plane, said clamping disks being operatively connected to said disks, respectively, so as to rotate therewith, said clamping disks having rims extending adjacent the fingers in said clamping area such that the fiber to be cut is clamped between said fingers and the rims of said clamping disks in the clamping area; and a cutting blade disposed in the clamping area at a location at which the blade will cut the fiber between the fingers clamping the fiber to the rims of the clamping disks.

2. An apparatus for cutting fiber as claimed in claim 1, and further comprising rotary shafts on which said finger disks are mounted, respectively, longitudinal axes of said rotary shafts constituting the axes of rotation of said finger disks, and wherein one of said rotary shafts is supported in the apparatus so as to be swingable in a second plane orthogonal to said first plane to thereby vary the distance between the fingers extending from one of the disks and the fingers extending from the other of said disks in said clamping area.

3. An apparatus for cutting fiber, comprising:

a pair of finger disks spaced apart from one another along a first axis passing through centers of each of said disks, each of said disks being rotatably supported about a respective axis of rotation passing through the center thereof, the axes of rotation of said disks intersecting at an oblique angle at a location between the disks such that peripheries of said disks are closest to one another at one location in the apparatus and are most remote from one another at another location in the apparatus;

a plurality of fingers spaced along and extending from the peripheries of each of said disks, the fingers of each one of said disks being hook-shaped by having a bend therein and a terminal end extending from the bend toward a rear side of said one of said disks in a direction away from the other of said disks, the fingers extending from one of said disks being alternately disposed, in the circumferential directions of the disks, with the fingers extending from the other of said disks, the fingers extending from one of said disks crossing the fingers of the other of said disks at said one location where the peripheries of the disks are closest to each other so as to define an interlocking area at said one location forming an inlet of the apparatus where fiber to be cut by the apparatus is input, the fingers extending from one of said disks being spaced, in a direction corresponding to that of said first axis, from the fingers extending from the other of said disks at said another location where the peripheries of the disks are most remote from one another so as to define a clamping area, and a hooking area being defined in the apparatus adjacent the peripheries of the disks at a third location between said interlocking area and said clamping area in the circumferential directions of said disks, fiber to be cut by the apparatus being held by said fingers in said hooking area in a zigzag configuration;

clamping members disposed to the rear sides of said disks, respectively, said clamping members extending adjacent the fingers in said clamping area such that the fiber to be cut is clamped between said fingers and the clamping members in the clamping area; and a cutting blade disposed in the clamping area at a location at which the blade will cut the fiber between the fingers clamping the fiber to the clamping members.

4. An apparatus for cutting fiber as claimed in claim 3, and further comprising rotary shafts on which said finger disks are mounted, respectively, longitudinal axes of said rotary shafts constituting the axes of rotation of said finger disks, and wherein one of said rotary shafts is supported in the apparatus so as to be swingable in a plane in which said first axis lies to thereby vary the distance between the fingers extending from one of the disks and the fingers extending from the other of said disks in said clamping area.

* * * * *